US009038694B2

(12) United States Patent
Hsieh

(10) Patent No.: US 9,038,694 B2
(45) **Date of Patent: *May 26, 2015**

(54) SUN SHADER APPARATUS

(71) Applicant: Paul Hsieh, City of Industry, CA (US)

(72) Inventor: Paul Hsieh, City of Industry, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/024,913

(22) Filed: Sep. 12, 2013

(65) Prior Publication Data

US 2014/0007410 A1 Jan. 9, 2014

Related U.S. Application Data

(63) Continuation of application No. 13/373,025, filed on Nov. 1, 2011, now Pat. No. 8,783,329.

(51) Int. Cl.

| | |
|---|---|
| ***E04F 10/00*** | (2006.01) |
| ***E04F 10/02*** | (2006.01) |
| ***A45B 23/00*** | (2006.01) |
| ***A63G 9/00*** | (2006.01) |

(52) U.S. Cl.

CPC ..... *E04F 10/02* (2013.01); *A45B 23/00* (2013.01); *A45B 2023/0093* (2013.01); *A45B 2200/1009* (2013.01); *A63G 9/00* (2013.01)

(58) Field of Classification Search

CPC ..... E04F 10/02; E04F 10/04

USPC ..... 160/45, 56, 83.1, 128; 472/118; 297/184.15, 184.17; 135/96, 115; 482/35

See application file for complete search history.

(56) References Cited

U.S. PATENT DOCUMENTS

| | | | | |
|---|---|---|---|---|
| 8,715,095 | B2 * | 5/2014 | Hsieh | 472/116 |
| 8,783,329 | B2 * | 7/2014 | Hsieh | 160/45 |
| 2014/0007410 | A1 * | 1/2014 | Hsieh | 29/525.01 |

* cited by examiner

*Primary Examiner* — Blair M Johnson

(74) *Attorney, Agent, or Firm* — Raymond Y. Chan; David and Raymond

(57) ABSTRACT

A sun shading apparatus includes a supporting frame, a shading frame and a shading fabric. The supporting frame includes first and second leg frames, and a supporting bar extended between the first and the second leg frames, while the second leg frame has third and fourth mounting slots. The shading frame includes first and second coupling joints each having a V-shaped cross section, first and second frame members, and a reinforcing frame, wherein the supporting bar is extended between the first and second coupling joints. The first and the second frame member are coupled with the first coupling joint and the second coupling joint respectively, while the reinforcing frame is extended between the first and second frame member and the supporting bar to form a support platform. The shading fabric is detachably mounted on the support platform for shading adverse weather condition.

20 Claims, 8 Drawing Sheets

SUN SHADER APPARATUS

CROSS REFERENCE OF RELATED APPLICATION

This is a Continuation application that claims the benefit of priority under 35 U.S.C. §119 to a non-provisional application, application Ser. No. 13/373,025, filed Nov. 2, 2011, now U.S. Pat. No. 8,783,329.

BACKGROUND OF THE PRESENT INVENTION

1. Field of Invention

The present invention relates to a shading apparatus, and more particularly to a sun shading apparatus comprising a shading frame which can be detachably attached onto a supporting frame so as to facilitate easy and convenient assembling and disassembling of the shading frame.

2. Description of Related Arts

A conventional shading device, such as an outdoor canopy or a gazebo, usually comprises a supporting frame, a shading frame upwardly extended from the supporting frame, and a shading fabric mounted on the shading frame for shading sunlight in an area underneath the shading fabric. Conventionally, the shading frame is mounted on the supporting frame in such a manner that the shading frame cannot be conveniently detached from the supporting frame. Moreover, each conventional shading device, such as a particular outdoor canopy, is specifically designed such that the shading frame can only be used for a predetermined supporting frame which comes with the entire package. As such, when either the supporting frame or the shading frame is broken or partially damaged, the owner has no choice but to purchase a new set of the shading device, because separate parts are usually not available or not compatible with existing supporting frame or the shading frame.

Moreover, conventional shading device usually does not allow the owner to add on additional structures. For example, when a user wishes to add a swing onto the shading device, the owner has to purchase a new set of swing and assemble it according to corresponding instructions. In other words, the swing has nothing to do with the shading device.

Because of this problem and because of the popularity of domestic swings, many swings do not come with a compatible shading device. As a result, the people, such as children, playing on the swing are directly exposed to sunlight and this may inhibit their willingness to continue playing because the weather may be too hot.

SUMMARY OF THE PRESENT INVENTION

The invention is advantageous in that it provides a sun shading apparatus comprising a shading frame which can be detachably attached onto a supporting frame so as to facilitate easy and convenient assembling and disassembling of the shading frame.

Another advantage of the invention is to provide a sun shading apparatus in which a shading frame can be detachably attached onto a pre-existing supporting frame, which can also support other structures, such a swing.

Another advantage of the invention is to provide a sun shading apparatus which is capable of providing effective yet convenient shading to activities taken place underneath the shading frame.

Another advantage of the invention is to provide a sun shading apparatus which is easy to be assembled and disassembled so as to facilitate widespread application of the present invention.

Additional advantages and features of the invention will become apparent from the description which follows, and may be realized by means of the instrumentalities and combinations particular point out in the appended claims.

According to the present invention, the foregoing and other objects and advantages are attained by providing a sun shading apparatus, comprising:

a supporting frame which comprises a first and a second leg frame, and a to supporting bar extended between the first and the second leg frames, wherein the first leg frame has a first and a second mounting slot, while the second leg frame has a third and a fourth mounting slot;

a shading frame, which comprises:

a first and a second coupling joints each having a V-shaped cross section detachably coupled with two ends of the supporting bar respectively;

a first and a second frame member, wherein the first frame member has two ends detachably coupled with the first and the third mounting slot of the first coupling joint and the second coupling joint respectively, while the second frame member has two ends detachably coupled with the second mounting slot and the fourth mounting slot of the first and the second coupling joint respectively; and a reinforcing frame extended between the first and second frame members and the supporting bar to form a support platform by the first and second frame member and the reinforcing frame; and a shading fabric detachably mounted on the support platform for shading adverse weather condition in an area underneath the shading fabric.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
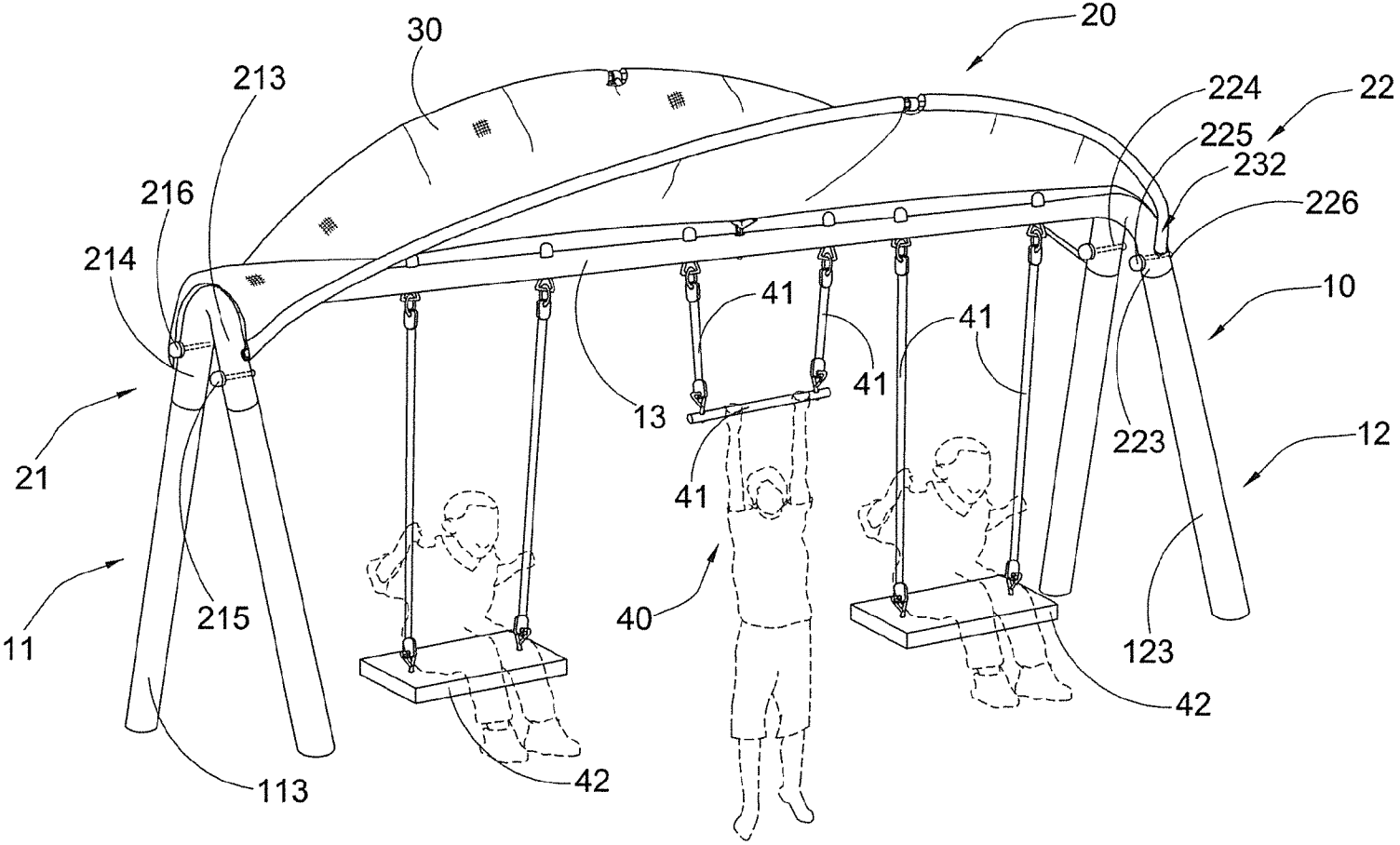
FIG. 1 is a perspective view of a sun shading apparatus according to a preferred embodiment of the present invention.

Referring to FIG. 1 to FIG. 2, FIG. 3A and FIG. 3B, and FIG. 4 of the drawings, a sun shading apparatus according to a preferred embodiment of the present invention is illustrated, in which the sun shading apparatus comprises a supporting frame 10, a shading frame 20, and a shading fabric 30.

The supporting frame 10 comprises a first and a second leg frame 11, 12 and a supporting bar 13 extended between the first and the second leg frame 11, 12, wherein the first leg frame 11 has a first and a second mounting slot 111, 112, while the second leg frame 12 has a third and a fourth mounting slot 121, 122.

The shading frame 20 comprises first and the second coupling joints 21, 22 each has a V-shaped cross section, wherein two ends of the supporting bar 13 are extended from the first and second coupling joints 21, 22 respectively.

On the other hand, the shading frame 20 comprises a first and a second frame member 23, 24, wherein the first frame member 23 has two ends 231, 232 detachably coupled with the first and the third mounting slot 111, 121 of the first leg frame 11 and the second leg frame 12 respectively, while the second frame member 24 has two ends 241, 242 detachably coupled with the second mounting slot and the fourth mounting slot 112, 122 of the first and the second leg frame 11, 12 respectively.

The reinforcing frame 25 is extended between the first and second frame members 23, 24 and the supporting bar 13 to form a support platform by the first and second frame member 23, 24 and the reinforcing frame 25, wherein the shading fabric 30 is detachably mounted on the support platform for shading adverse weather condition in an area underneath the shading fabric 30.

According to the preferred embodiment of the present invention, the supporting frame 10 is for supporting the entire structure of the present invention, including any accessories or equipment attached onto the supporting bar 13. Thus, if the sun shading apparatus has a utility device 40 such as a swing detachably attached thereon, it would be supported by the supporting bar 12.

The first leg frame 11 comprises a plurality of first legs 113 inclinedly extended from the ground surface toward the supporting bar 13, wherein the first coupling joint 21 is mounted between the supporting bar 13 and the first legs 113. Moreover, the first and the second mounting slot 111, 112 are formed on the first coupling joint 21.

On the other hand, the second leg frame 12 comprises a plurality of second legs 123 inclinedly extended from the ground surface toward the supporting bar 13, wherein the second coupling joint 22 is mounted between the supporting bar 13 and the second legs 123. Moreover, the third and the fourth mounting slot 121, 122 are formed on the second coupling joint 22.

The first coupling joint 21 of the shading frame 20 preferably has a first joint body 213 and a second joint body 214 inclinedly extended from the corresponding end of the supporting bar 13 to form a V-shaped cross section, wherein the first coupling joint 21 further has a first and a second connecting slot 211, 212 formed on the first and the second joint body 213, 214 respectively. Similarly, the second coupling joint 22 of the shading frame 20 also has a third and a fourth joint body 223, 224 inclinedly extended from the corresponding end of the supporting bar 13 to also form a V-shaped cross section, wherein the second coupling joint 22 further has a third and a fourth connecting slot 221, 222 formed on the third and the fourth joint body 223, 224 respectively.

It is worth mentioning that each of the first through second joint body 213, 214, connect the first legs 113 with the corresponding end of the supporting bar 13 while the third through fourth joint body 223, 224 connect the second legs 123 to the corresponding end of the supporting bar 13 in this preferred embodiment. However, as a slight alternative, the V-shaped structure of the first and the second coupling joint 21, 22 can detachably ride on the two end portions of the supporting bar 12 respectively so as to connect the supporting bar 13 with the first and the second leg frames 11, 12.

Each of the first and the second frame member 23, 24 is elongated in shape and is made of strong yet slightly flexible materials (preferably bendable) for supporting the shading fabric 30. Moreover, each of the first and the second frame member 23, 24 is curved in shape so that when they are mounted on the first and the second leg frames 11, 12, they form a slightly concave structure for supporting the shading fabric 30 in a corresponding shape. In other words, the shading fabric 30 is supported in such a manner that it is arranged to form a concave structure for the sun shading apparatus.

The first frame member 23 further has a plurality of first connectors 233 formed at two ends 231, 232 thereof, wherein the first connectors 233 are arranged to detachably insert into the first mounting slot 111 and the third mounting slot 121 respectively so as to extend across the first leg frame 11 and the second leg frame 12 in a longitudinal direction of the sun shading apparatus. On the other hand, the second frame member 24 has a plurality of second connectors 243 formed at two ends 241, 242 thereof, wherein the second connectors 243 are arranged to detachably insert into the second mounting slot 112 and the fourth mounting slot 122 respectively so as to extend across the first leg frame 11 and the second leg frame 12 in a similar manner as that of the first frame member 23.

Figure 3A:
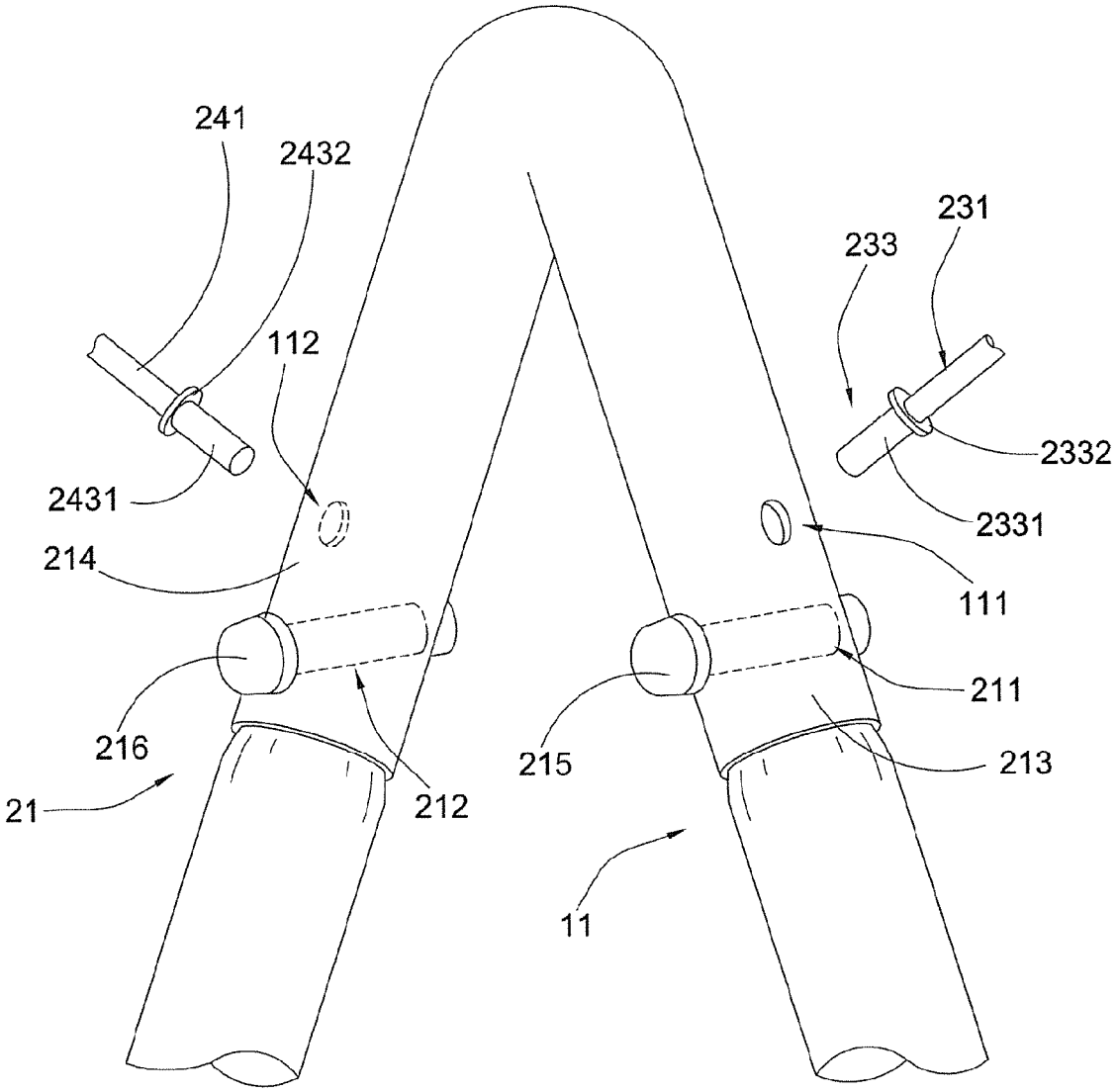
FIG. 3A and FIG. 3B are schematic diagrams of the first and the second connectors of the shading apparatus according to the above preferred embodiment of the present invention.
Figure 3B:
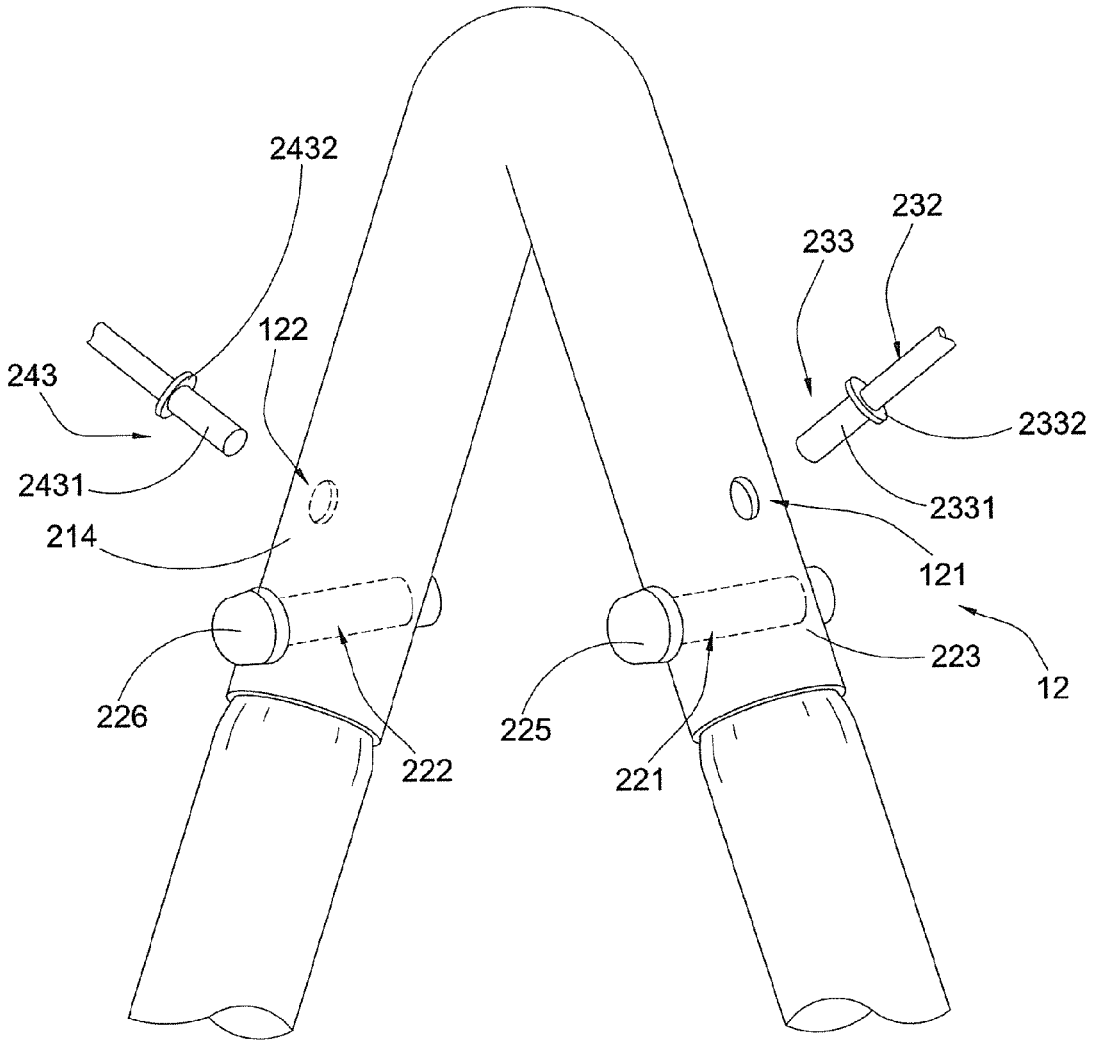
Figure 4:
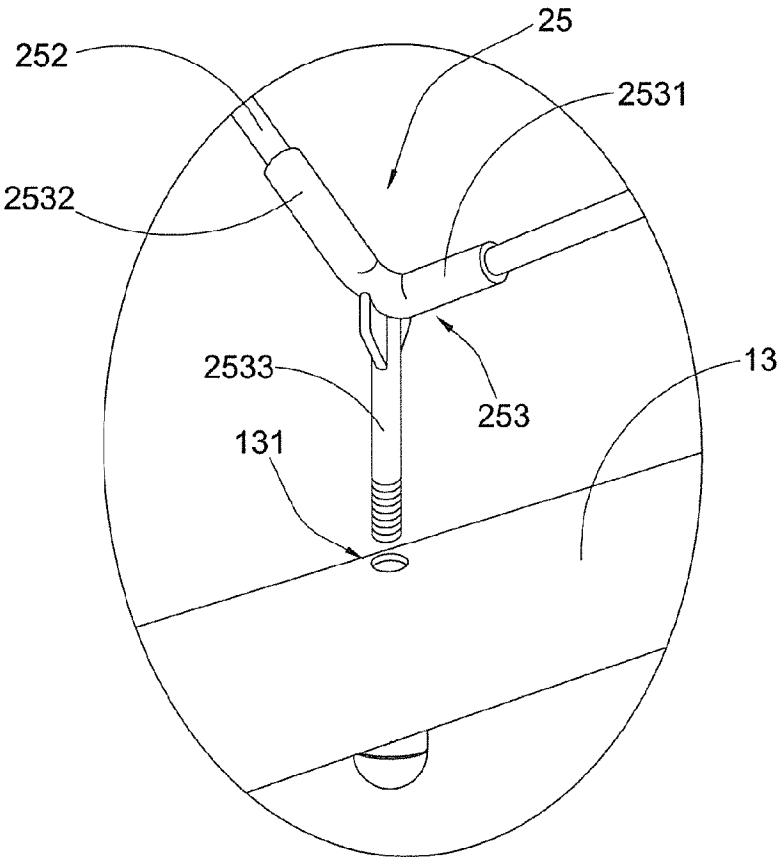
FIG. 4 is a schematic diagram of the reinforcing joint of the sun shading apparatus according to the above preferred embodiment of the present invention.

As shown in FIG. 3A of the drawings, each of the first connectors 233 has a first body portion 2331 arranged to be inserted into the corresponding mounting slot 111 (121), and a first stopper portion 2332 transversely and radially extended from the first body portion 2331 to stop a further inward movement of the first body portion 2331 of the first connectors 233. Similarly, as shown in FIG. 3B of the drawings, each of the second connectors 243 has a second body portion 2431 arranged to be inserted into the corresponding mounting slot 112 (122), and a second stopper portion 2332 transversely and radially extended from the second body portion 2431 to stop a further inward movement of the second body portion 2431 of the second connectors 243.

Furthermore, the first coupling joint 21 further comprises a first and a second coupler 215, 216 provided at the first and the second connecting slot 211, 212 respectively, wherein the first legs 113 are adapted to detachably mount to the first and the second joint body 213, 214 and selectively locked up by the first and the second coupler 215, 216 respectively.

Similarly, the second coupling joint 22 further comprises a third and a fourth coupler 225, 226 provided at the third and the fourth connecting slot 221, 222 respectively, wherein the second legs 123 are adapted to detachably mount to the third and the fourth joint body 223, 224 and selectively locked up by the third and the fourth coupler 225, 226 respectively.

The reinforcing frame 25 comprises a first and a second reinforcing member 251, 252 extended from the first frame member 23 and the second frame member 24 toward the supporting bar 13, and a reinforcing joint 253 provided at an intersection of the first reinforcing member 251, the second reinforcing member 252 and the supporting bar 13 so as to detachably connect the first reinforcing member 251 and the second reinforcing member 252 with the supporting bar 13.

It is worth mentioning that the first and the second reinforcing member 251,252 may be two separate elements which are connected to the reinforcing joint 253. However, the first and the second reinforcing member 251, 252 may be integrally extended with each other for forming a V-shaped or U-shaped reinforcing frame 25. In any event, the reinforcing joint 253 is responsible for jointing the first and the second reinforcing member 251, 252 with the supporting bar 13.

Thus, the reinforcing joint 253 has first, second, and third joint members 2531, 2532, 2533 each having one end portion connected with the first reinforcing member 251, the second reinforcing member 252, and the supporting bar 13 respectively, and another end portion connected with each other. The supporting bar 13 further has a supporter slot 131 formed at a mid portion thereof, wherein the third joint member 2533 is arranged to insert into the supporter slot 131 and locked up by a securing connector 132 so as to mount the first and the second reinforcing member 251, 252 on the supporting bar 13 through the reinforcing joint 253.

The reinforcing frame 25 further comprises a first and a second fastening joint 254, 255 joining the first reinforcing member 251 with the first frame member 23, and joining the second reinforcing member 252 with the second frame member 24 respectively. More specifically, the first fastening joint 254 has a first tubular portion 2541 connected with the first frame member 23, and a first affixing portion 2542 extended from the first tubular portion 2541 and connected to the first reinforcing member 251. Similarly, the second fastening joint 255 has a second tubular portion 2551 connected with the second frame member 24, and a second affixing portion 2552 extended from the second tubular portion 2551 and connected to the second reinforcing member 252.

It is worth mentioning that the connection between the first fastening joint 254 with the first frame member 23 and the connection between the second fastening joint 255 and the second frame member 24 can be a slidable connection, a secure connection, and/or a detachable connection depending on the circumstances in which the present invention is manufactured or marketed.

Figure 2:
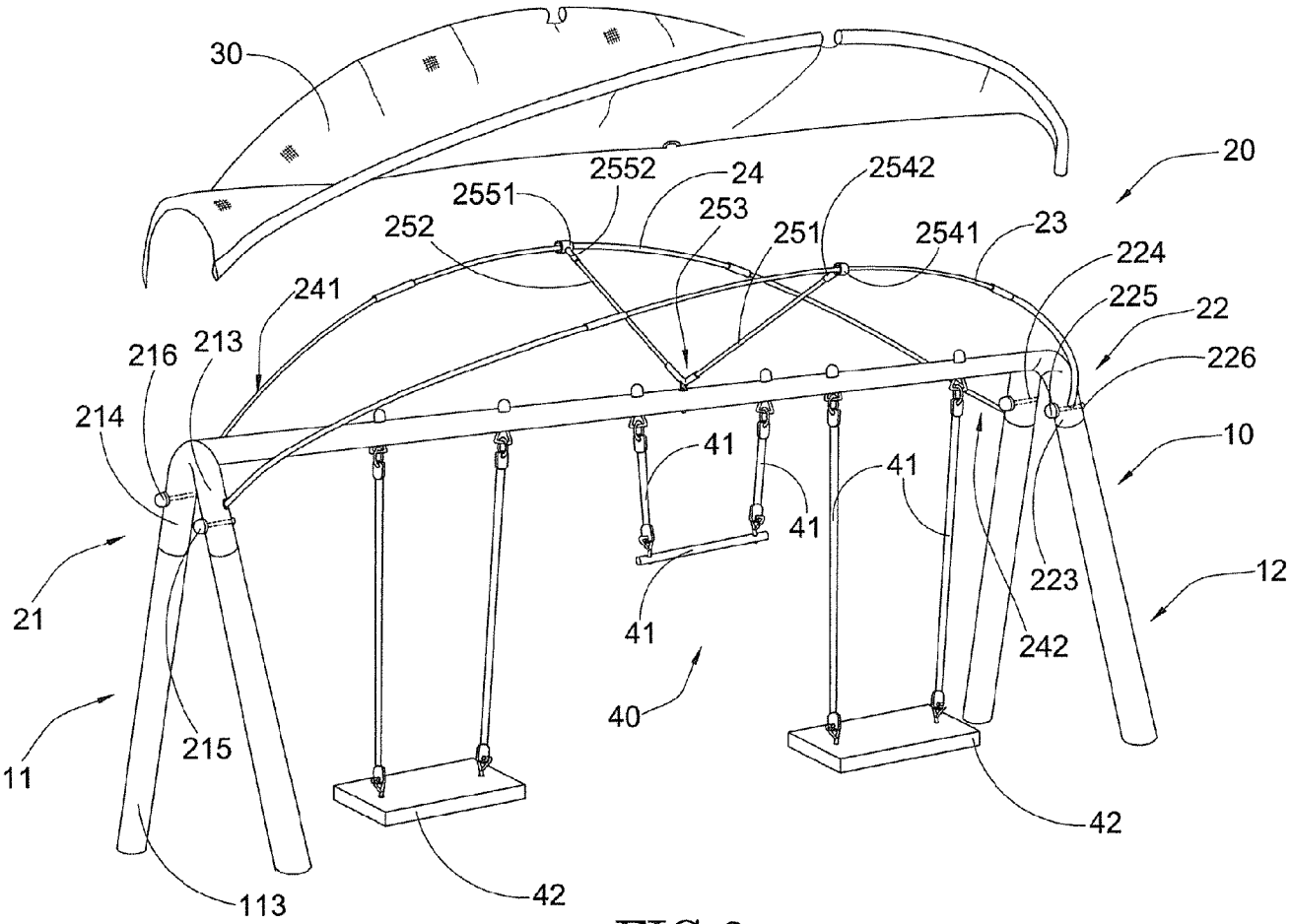
FIG. 2 is an exploded perspective view of the sun shading apparatus according to the above preferred embodiment of the present invention.

As shown in FIG. 1 and FIG. 2 of the drawings, the supporting frame 10 can be attached by a utility device 40 so that the utility device 40 is effectively shielded from sunlight. For example, when the utility device 40 is embodied as a swing, the utility device 40 may comprise a plurality of utility members 41 pivotally mounted on the supporting bar 13 and a seating member 42 extended across lower portions of the utility members 41 so that a person may seat on the seating member 42 and grab on the utility members 41 and perform swinging motions. The swing is fully and securely supported by the supporting frame 10, which is shielded by the sun shading frame 20 and the shading fabric 30. On the other hand, the utility device 40 may also be embodied as a training station in which the utility members 41 form training bars for the user to perform push-up exercise.

It is important to point out that the sun shading frame 20 is entirely detachably attached on the supporting frame 10 so that a user is able to conveniently assemble or disassemble the sun shading apparatus of the present invention. Moreover, the user is also able to detachably mount the sun shading frame 20 onto an existing supporting frame 10. This can be accomplished by mounting the first and the second coupling joint 21, 22 onto an existing supporting bar 13.

Figure 5:
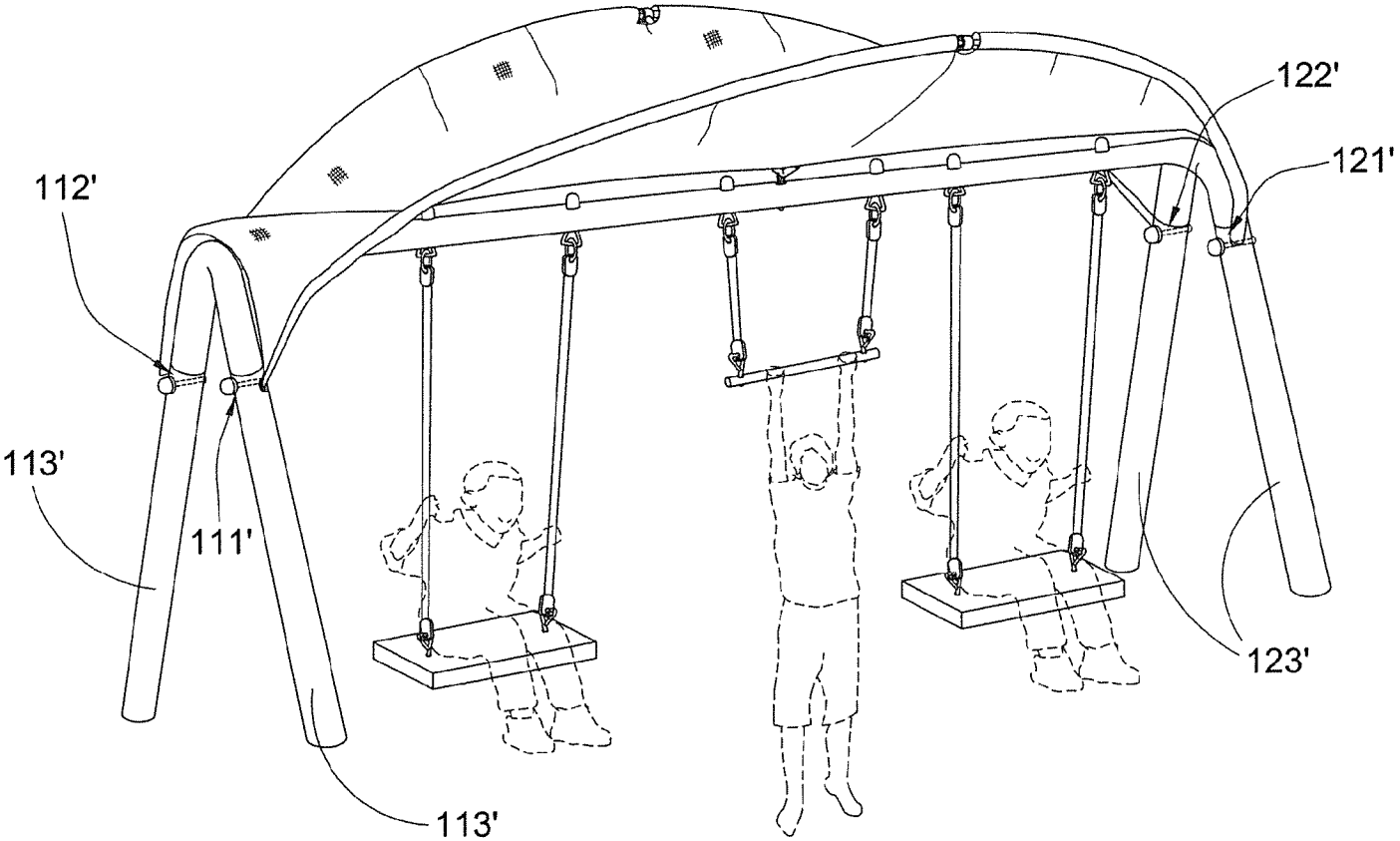
FIG. 5 is a first alternative mode of the sun shading apparatus according to the above preferred embodiment of the present invention.

Referring to FIG. 5 of the drawings, a first alternative mode of the sun shading apparatus according to the preferred embodiment of the present invention is illustrated. The alternative mode is similar to the preferred embodiment except the positions of the first through fourth mounting slot 111', 112', 121', 122'. In the alternative mode, the first through second mounting slot 111', 112' are formed on the first legs 113' while the third through fourth mounting slot 121', 122' are formed on the second legs 123'. Thus, the first and the second frame member 23', 24' are arranged to connect to the first legs 113' and the second legs 123' through the first through fourth connecting slot 111', 112', 121', 122'.

Figure 6A:
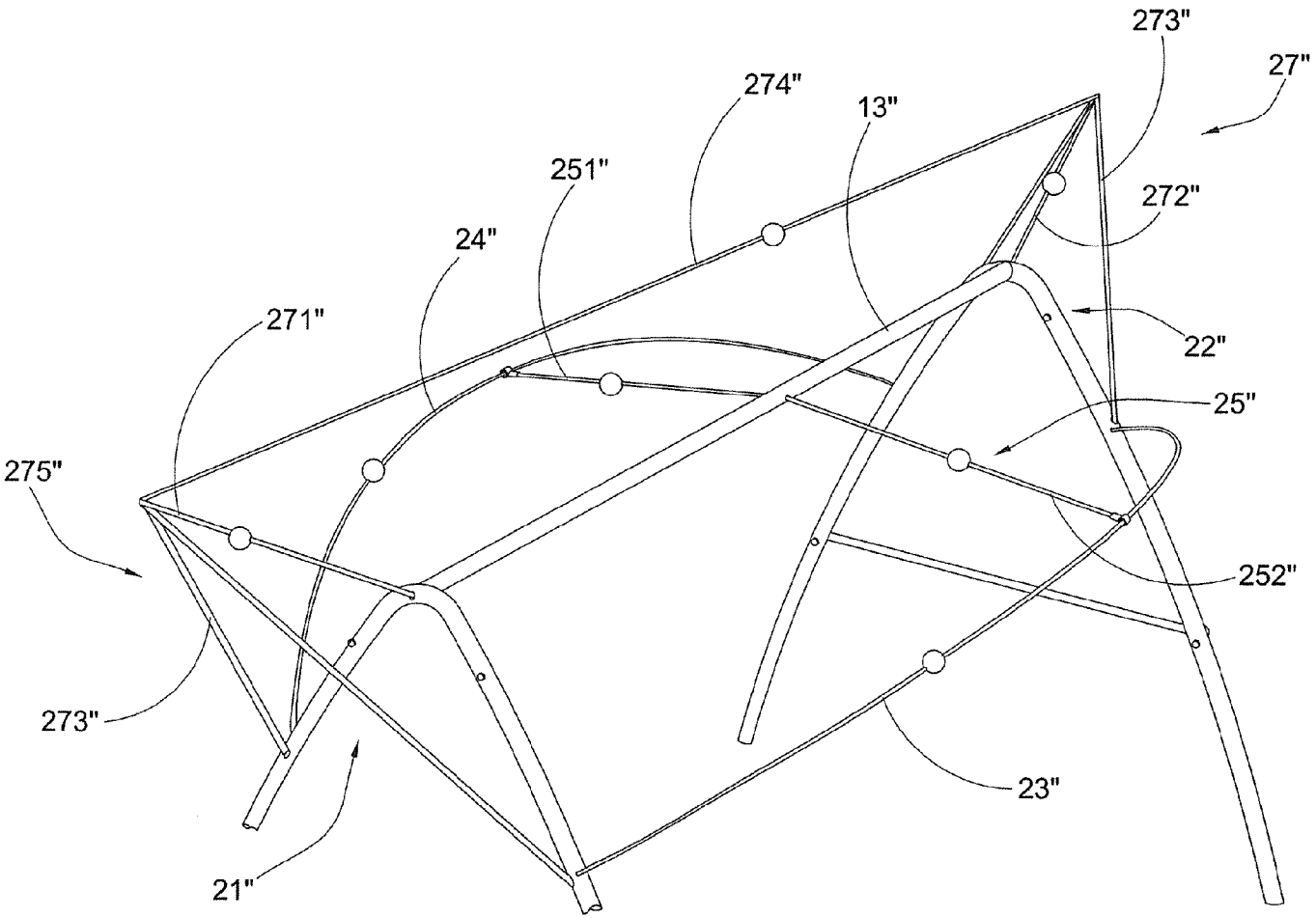
FIG. 6A and FIG. 6B are schematic diagrams of a second alternative mode of the sun shading apparatus according to the above preferred embodiment of the present invention.
Figure 6B:
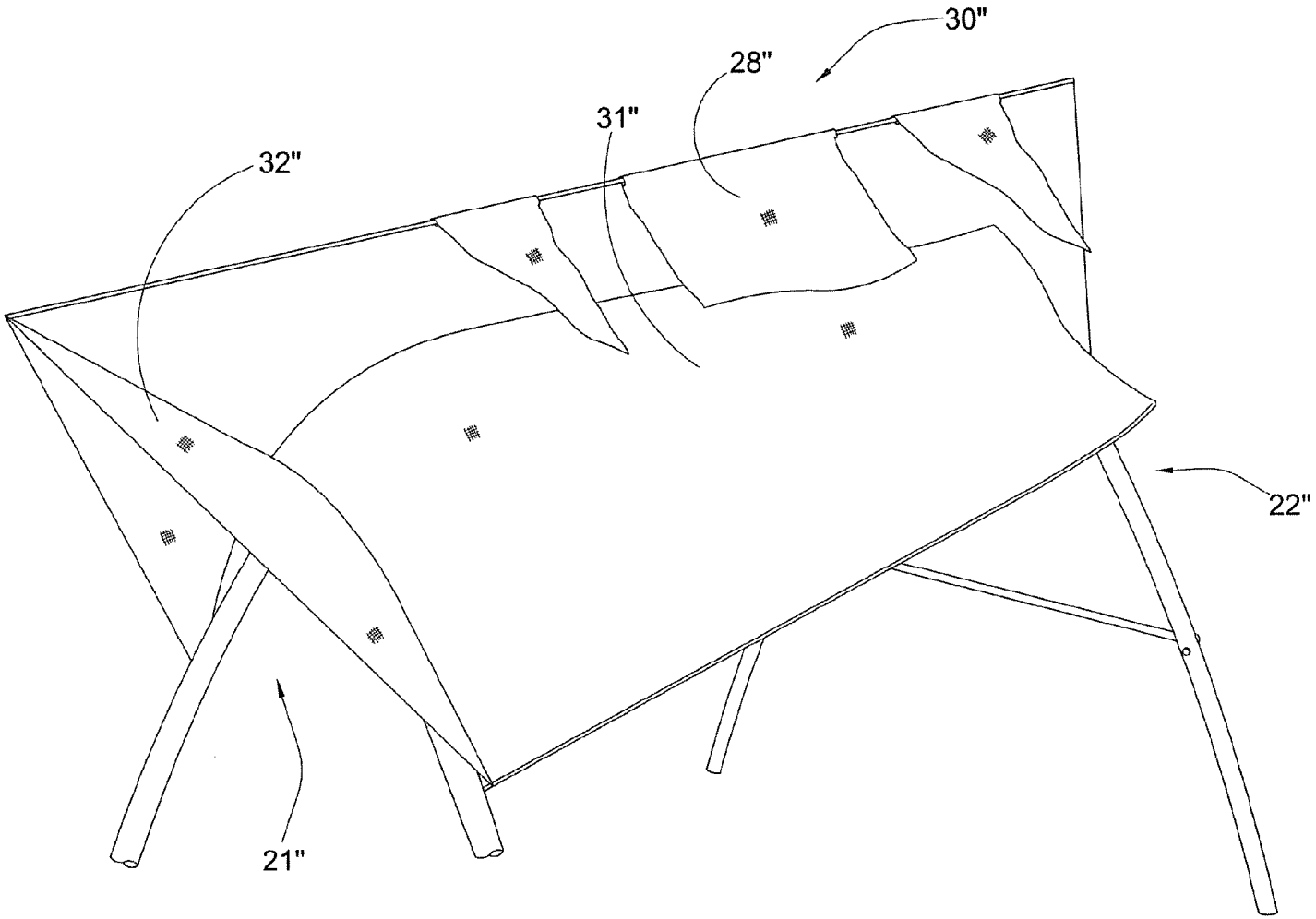

Referring to FIG. 6A to FIG. 6B of the drawings, a second alternative mode of the sun shading apparatus according to the preferred embodiment of the present invention is illustrated. The second alternative mode is similar to the preferred embodiment except the positions of the reinforcing frame 25", and that the shading frame 20" further comprises an auxiliary frame 27" provided on top of the supporting frame 10. According to the second alternative mode, the reinforcing frame 25" comprises a first and a second reinforcing member 251", 252" extended from the first frame member 23" and the second frame member 24" toward the supporting bar 13", wherein the first and the second frame member 23", 24" are sidewardly extended from the supporting frame 10 so as to form the corresponding support platform.

Furthermore, the auxiliary frame 27" comprises a first and a second auxiliary frame member 271", 272" upwardly extended from the first and the second coupling joint 21", 22" respectively, and a plurality of supporting members 273" extended between top ends of the first and the second auxiliary frame member 271", 272" and the corresponding coupling joints 21", 22" respectively for forming an auxiliary support platform 275". In addition, the auxiliary frame 27" further comprises a ceiling frame member 274" extended between the top ends of the first and the second auxiliary frame member 271", 272" for supporting predetermined accessories, such as flags 28".

Accordingly, the shading fabric 30" according to this second alternative mode comprises a main fabric 31" provided on the support platform and two auxiliary fabrics 32" provided on the auxiliary support platform 275" at two sides of the main fabric 31" respectively.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method of assembling a sun shading apparatus, comprising the steps of:

(a) coupling first and second leg frames with V-shaped first and second coupling joints respectively and extending a supporting bar between said first and second coupling joints, wherein said first coupling joint has a first joint body and a second joint body inclinedly extended from said corresponding end of said supporting bar to form a V-shaped cross section, wherein said second coupling joint has a third and a fourth joint body inclinedly extended from said corresponding end of said supporting bar to also form a V-shaped cross section;

(b) detachably coupling two ends of a first frame member with said first and second leg frames, and detachably coupling two ends of a second frame member with said first and second leg frames;

(c) extending a reinforcing frame between said first and second frame members and said supporting bar to form a support platform by said first and second frame member and said reinforcing frame; and (d) detachably mounting a shading fabric on said support platform for shading adverse weather condition in an area underneath said shading fabric.

2. The method, as recited in claim 1, wherein the step (b) further comprises the steps of:

(b.1) providing first and second mounting slots at said first leg frame, and third and fourth mounting slots at said second leg frame;

(b.2) detachably coupling said ends of said first frame member with said first and third mounting slots of said first and second coupling joints respectively; and (b.3) detachably coupling said ends of said second frame member with said second and fourth mounting slots of said first and second coupling joints respectively.

3. The method, as recited in claim 2, wherein the step (b.2) further comprises a step of:

providing a plurality of first connectors at two ends of said first frame member to detachably insert into said first and third mounting slots respectively and extending across said first and second leg frames in a longitudinal direction of said sun shading apparatus;

wherein the step (b.3) further comprises a step of:

detachably inserting a plurality of second connectors formed at two ends of said second frame member into said second and fourth mounting slots respectively and extending across said first and second leg frames in a longitudinal direction of said sun shading apparatus.

4. The method, as recited in claim 1, wherein the step (a) further comprises the steps of:

(a.1) inclinedly extending a plurality of first legs of said first leg frame from a ground surface toward said supporting bar, and inclinedly extending a plurality of second legs of said second leg frame from said ground surface toward said supporting bar; and (a.2) connecting said first legs to said first and second joint bodies of said first coupling joint respectively and connecting said second legs to said third and fourth joint bodies of said first coupling joint respectively.

5. The method, as recited in claim 3, wherein the step (a) further comprises the steps of:

(a.1) inclinedly extending a plurality of first legs of said first leg frame from a ground surface toward said supporting bar, and inclinedly extending a plurality of second legs of said second leg frame from said ground surface toward said supporting bar; and (a.2) connecting said first legs to said first and second joint bodies of said first coupling joint respectively and connecting said second legs to said third and fourth joint bodies of said first coupling joint respectively.

6. The method, as recited in claim 4, wherein the step (a.2) further comprises the steps of:

(a.2.1) providing first and second connecting slots at said first and second joint bodies respectively, and providing third and fourth connecting slots at said third and fourth joint bodies respectively;

(a.2.2) providing first and second couplers at said first and second connecting slots respectively, and providing third and fourth couplers at said third and fourth connecting slots respectively; and (a.2.3) detachably locking said first legs to said first and second joint bodies by said first and second couplers respectively, and detachably locking said second legs to said third and fourth joint bodies by said third and fourth couplers respectively.

7. The method, as recited in claim 5, wherein the step (a.2) further comprises the steps of:

(a.2.1) providing first and second connecting slots at said first and second joint bodies respectively, and providing third and fourth connecting slots at said third and fourth joint bodies respectively;

(a.2.2) providing first and second couplers at said first and second connecting slots respectively, and providing third and fourth couplers at said third and fourth connecting slots respectively; and (a.2.3) detachably locking said first legs to said first and second joint bodies by said first and second couplers respectively, and detachably locking said second legs to said third and fourth joint bodies by said third and fourth couplers respectively.

8. The method, as recited in claim 1, wherein the step (c) further comprises the steps of:

(c.1) configuring each of said first and second frame members to have an elongated shape and being made of strong yet slightly flexible materials for supporting said shading fabric; and (c.2) configuring said supporting platform to form a slightly concave structure for supporting said shading fabric in a corresponding shape when said first and said second member are mounted on said first and second leg frames.

9. The method, as recited in claim 7, wherein the step (c) further comprises the steps of:

(c.1) configuring each of said first and second frame members to have an elongated shape and being made of strong yet slightly flexible materials for supporting said shading fabric; and (c.2) configuring said supporting platform to form a slightly concave structure for supporting said shading fabric in a corresponding shape when said first and said second member are mounted on said first and second leg frames.

10. The method, as recited in claim 8, wherein in the step (c), said reinforcing frame comprises first and second reinforcing members and the step (c) further comprises the steps of:

(c.3) extending said first and second reinforcing members of said reinforcing frame from said first frame member and said second frame member toward said supporting bar; and (c.4) detachably connecting said first reinforcing member and said second reinforcing member with said supporting bar by a reinforcing joint provided at an intersection of said first reinforcing member, said second reinforcing member and said supporting bar.

11. The method, as recited in claim 9, wherein in the step (c), said reinforcing frame comprises first and second reinforcing members and the step (c) further comprises the steps of:

(c.3) extending said first and second reinforcing members of said reinforcing frame from said first frame member and said second frame member toward said supporting bar; and (c.4) detachably connecting said first reinforcing member and said second reinforcing member with said supporting bar by a reinforcing joint provided at an intersection of said first reinforcing member, said second reinforcing member and said supporting bar.

12. The method, as recited in claim 10, wherein the step (c.4) further comprises the steps of:

(c.4.1) configuring said reinforcing joint to have first, second, and third joint members (c.4.2) connecting said first and second joint members of said reinforcing joint with said reinforcing member and said second reinforcing member respectively;

(c.4.3) providing a supporter slot at a mid portion of said supporting bar; and (c.4.4) inserting said third joint member into said supporter slot to mount said first and said second reinforcing member on said supporting bar.

13. The method, as recited in claim 11, wherein the step (c.4) further comprises the steps of:

(c.4.1) configuring said reinforcing joint to have first, second, and third joint members (c.4.2) connecting said first and second joint members of said reinforcing joint with said reinforcing member and said second reinforcing member respectively;

(c.4.3) providing a supporter slot at a mid portion of said supporting bar; and (c.4.4) inserting said third joint member into said supporter slot to mount said first and said second reinforcing member on said supporting bar.

14. The method, as recited in claim 12, wherein the step (c) further comprises the steps of:

(c.5) configuring a first fastening joint to have a first tubular portion and a first affixing portion extended from said first tubular portion, and configuring a second fastening joint to have a second tubular portion and a second affixing portion extended from said second tubular portion;

(c.6) connecting said first tubular portion of said first fastening joint to said first frame member, and connecting said first affixing portion of said first fastening joint to said first reinforcing member in order to join said first reinforcing member with said first frame member; and (c.7) connecting said second tubular portion of said second fastening joint to said second frame member, and connecting said second affixing portion of said second fastening joint to said second reinforcing member in order to said second reinforcing member with said second frame member.

15. The method, as recited in claim 13, wherein the step (c) further comprises the steps of:

(c.5) configuring a first fastening joint to have a first tubular portion and a first affixing portion extended from said first tubular portion, and configuring a second fastening joint to have a second tubular portion and a second affixing portion extended from said second tubular portion;

(c.6) connecting said first tubular portion of said first fastening joint to said first frame member, and connecting said first affixing portion of said first fastening joint to said first reinforcing member in order to join said first reinforcing member with said first frame member; and (c.7) connecting said second tubular portion of said second fastening joint to said second frame member, and connecting said second affixing portion of said second fastening joint to said second reinforcing member in order to said second reinforcing member with said second frame member.

16. The method, as recited in claim 1, further comprising a step of (e) providing at least a swing at said supporting bar.

17. The method, as recited in claim 8, wherein in the step (c), said reinforcing frame comprises first and second reinforcing members and the step (c) further comprises a step of:

(c.3) extending said first and second reinforcing members of said reinforcing frame from said first frame member and said second frame member toward said supporting bar and extending sidewardly from said supporting frame in order to form said corresponding support platform.

18. The method, as recited in claim 17, wherein the step (c) further comprises the steps of:

(c.4) upwardly extending first and second auxiliary frame members from said first and second coupling joints respectively; and (c.5) extending a plurality of supporting members between top ends of said first and second auxiliary frame members and said corresponding coupling joints respectively for forming an auxiliary support platform.

19. The method, as recited in claim 18, wherein the step (c.4) further comprises a step of:

(c.4.1) extending a ceiling frame member between said top ends of said first and said second auxiliary frame member for supporting predetermined accessories.

20. The method, as recited in claim 19, wherein the step (d) further comprising the steps of:

(d.1) providing a main fabric on said support platform; and (d.2) providing two auxiliary fabrics on said auxiliary support platform at two sides of said main fabric respectively.

* * * * *